United States Patent [19]

Bankar

[11] Patent Number: 4,999,891

[45] Date of Patent: Mar. 19, 1991

[54] YARN HANDLING DEVICE AND METHOD

[75] Inventor: Vilas G. Bankar, Seaford, Del.

[73] Assignee: E. I. Du Pont de Nemours and Company, Wilmington, Del.

[21] Appl. No.: 430,894

[22] Filed: Oct. 31, 1989

[51] Int. Cl.[5] ..... D02G 1/16; D02G 1/20; D02G 1/00

[52] U.S. Cl. ..... 28/272; 28/271; 28/273; 57/22

[58] Field of Search ..... 28/271, 272, 273; 57/22

[56] References Cited

U.S. PATENT DOCUMENTS

| | | | |
|---|---|---|---|
| 2,667,964 | 2/1954 | Miller | 203/100 |
| 3,156,395 | 11/1964 | Ashby et al. | 226/7 |
| 3,474,615 | 10/1964 | Irwin et al. | 28/272 X |
| 3,863,435 | 2/1975 | Johnson | 57/159 |
| 3,971,108 | 7/1976 | Gorrafa | 28/272 |
| 4,391,086 | 7/1983 | Doherty, III | 57/22 |

*Primary Examiner*—Werner H. Schroeder
*Assistant Examiner*—Bibhu Mohanty

[57] ABSTRACT

A yarn string-up gun is modified to include an entangling jet and a cut-down device eliminating the need to provide entangling jets for joining yarns on each yarn-spinning machine position for intermittent use.

3 Claims, 2 Drawing Sheets

YARN HANDLING DEVICE AND METHOD

BACKGROUND OF THE INVENTION

This invention relates to a yarn handling device and, in particular, to a portable device capable of joining a first running length of yarn to a second running length of yarn and entangling the two with a jet of fluid.

Several methods along with apparatus for joining a yarn to a running yarn are known, such as disclosed in U.S. Pat. Nos. 3,863,435 and 4,391,086. In both of these patents, one or more air jets for entangling the first and second yarns are provided on each spinning machine position and the first and second yarns are placed into the entangling jets for joining. These patents also disclose that a vacuum string-up gun of the type disclosed by Miller U.S. Pat. No. 2,667,964 is useful in manipulating the yarn on a spinning position. It would be much less expensive if the air jets for entangling and their associated air piping and controls did not have to be provided at each threadline on each machine position, particularly since they are only used during a very small portion of the total yarn production cycle.

SUMMARY OF THE INVENTION

It has now been found that an entangling jet may be mounted on a single vacuum string-up gun to serve a plurality of spinning positions, thus eliminating the need for entangling equipment at each threadline on each machine position. The apparatus comprises an entangling jet having a yarn passage with a string-up slot and one or more air orifices directed tangentially, radially, or at intermediate locations into the yarn passage, a support structure attached to an air-operated string-up gun for positioning the entangling jet near the yarn entrance at the string-up gun, and an air valve to deliver compressed air momentarily to the entangling jet when the yarns are in position for joining. Optionally, a cutter operated by the same compressed air may be provided near the entrance to the string-up gun.

The method comprises: passing a first yarn from a yarn source through a yarn passage of an entangling jet and into the entrance of a vacuum string-up gun to which the jet and its support are connected, placing the yarn passage of the entangling jet over a second running yarn so that both yarns are running in the same direction in contact with one another, directing compressed air momentarily into one or more air orifices of the entangling jet to join the two yarns together, and severing said first yarn while removing the entangling jet from the running yarns.

DETAILED DESCRIPTION OF THE ILLUSTRATED EMBODIMENTS

Figure 1:
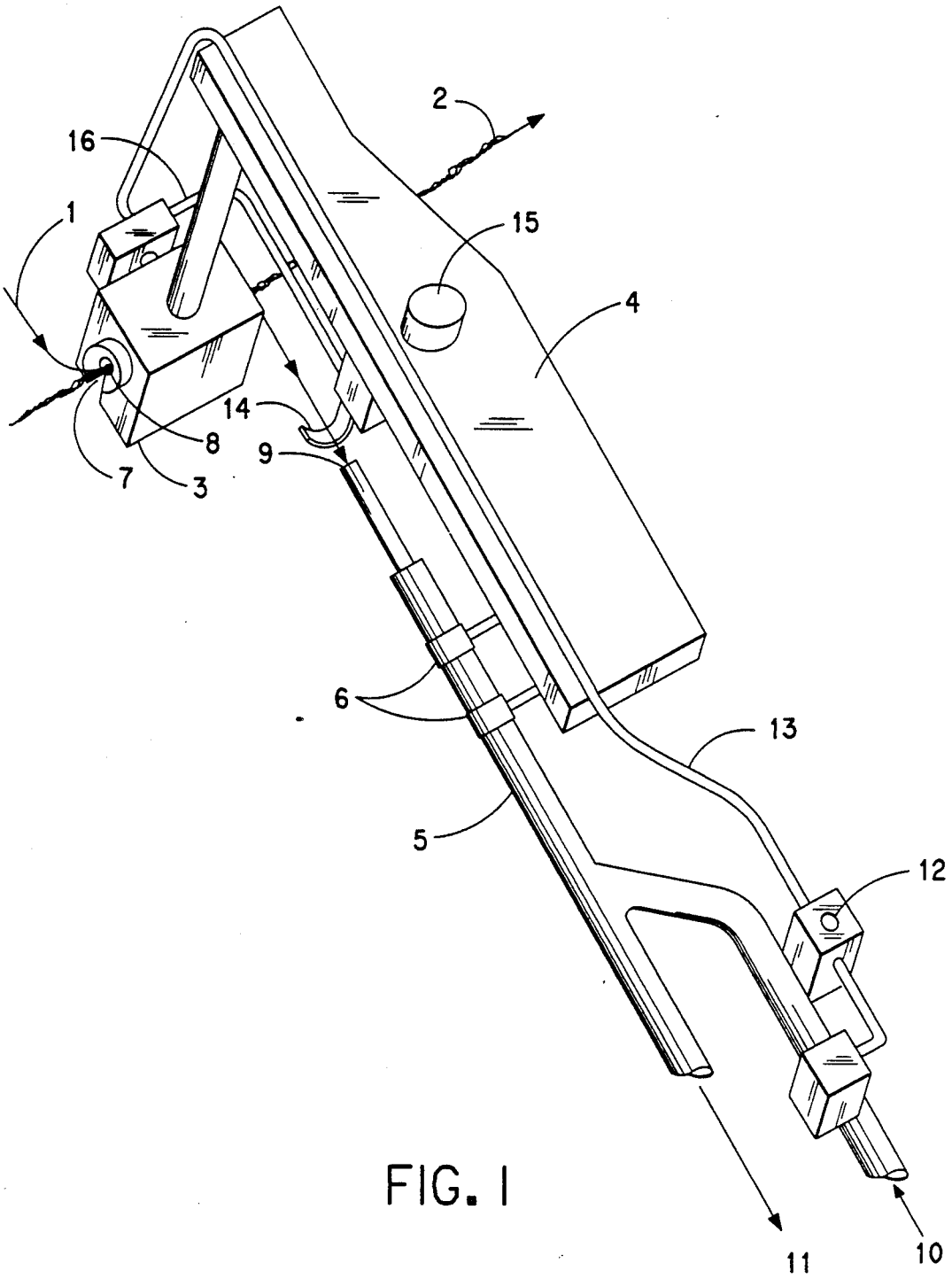
FIG. 1 is a schematic perspective view of the apparatus of the invention.

Referring to FIG. 1, air entangling jet 3 is attached to support plate 4 which in turn is joined to string-up gun 5 by clamps 6. Entangling jet 3 is shown in more detail in FIGS. 2A–2C but in any case must have a slot 7 or other opening through which the yarns enter the device. The machine operator takes an end of yarn 1 from a supply package (not shown), passes it through slot 7 into yarn passage 8 and then places it into yarn entrance 9 of string-up gun 5, within which compressed air entering at 10 through a flexible hose produces a high-velocity air stream directed from yarn entrance 9 toward exit 11 into another flexible hose to a waste yarn collection facility. String-up gun 5 may be of any suitable type such as is shown in Miller U.S. Pat. No. 2,667,964 or Ashby U.S. Pat. No. 3,156,395.

With yarn 1 running through the apparatus, the operator then places slot 7 of entangling jet 3 over running yarn 2 in such manner that both yarns are running in the same direction and opens normally closed air switch 12 (Part No. MV3, Air-Mite Devices, Inc., Chicago, Ill.) momentarily to direct compressed air through tube 13 into entangling jet 3 to entangle the filaments of yarn 1 with those of yarn 2. If yarn 1 is considerably smaller and/or weaker than yarn 2, as is often the case, yarn 1 will break as it is pulled by yarn 2. If yarn 1 is large or of high tenacity, a cutter 14 (Part No. YCRH-50, Slack and Parr, Charlotte, N.C.) operated by air cylinder 15 fed with compressed air through tube 16 at the same time that entangling jet 3 is energized and will cut yarn 1 satisfactorily.

The position of entangling jet 3 with respect to string-up gun 5 may be different from that shown in FIG. 1 and is determined mainly by the ease with which an operator can position the apparatus to engage running yarn 2 on different types of spinning equipment. The position of the jet may even be made adjustable if right-hand and left-hand spinning positions need to be serviced alternately. In this case, the air supply lines to the jet would either be made flexible or air would be supplied to the jet through passages within the supporting structure.

Figure 2A:
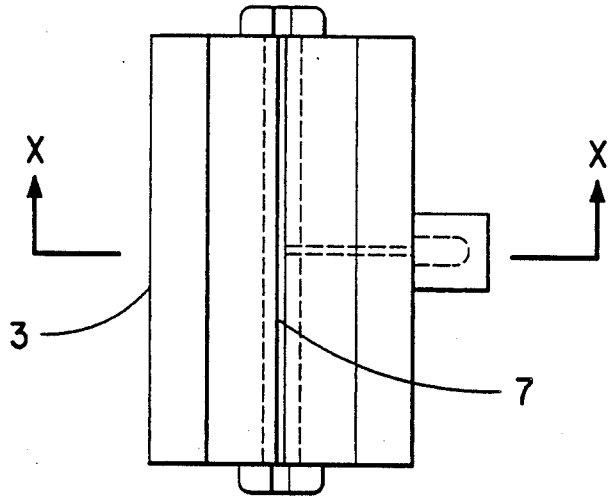
FIGS. 2A and 2B are top and end schematic views respectively of an entangling jet useful in practicing this invention.
Figure 2B:
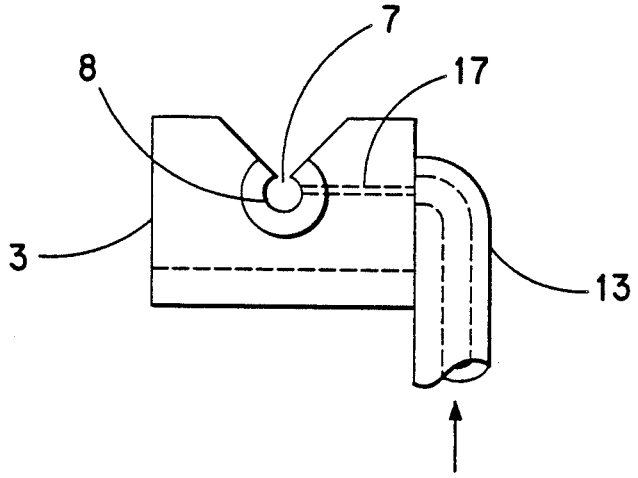
Figure 2C:
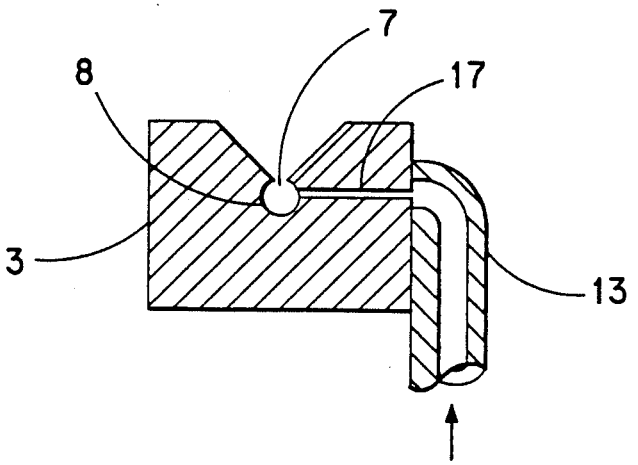
FIG. 2C is a schematic cross sectional view of FIG. 2A taken along line X—X.

As best shown in FIGS. 2A–2C, compressed air as indicated by the arrow enters jet 3 through tube 13 and air orifice 17 which is located slightly above the centerline of yarn passageway 8. This gives a twisting motion to the yarns in addition to an entangling action. Although the particular entangling jet shown in FIGS. 2A–2C produces a twisting moment to wrap the two yarns around each other as well as to entangle the filaments of yarn 1 with yarn 2, other types of entangling jets can be employed, depending on the degree of entanglement required. The jet and supporting structure may be made sufficiently strong to avoid damage from inevitable contacts with the spinning machine elements and may be reduced in size so as not to obstruct the operator's view of the yarn paths, especially while placing entangling jet 3 over running yarn 2.

I claim:

1. A portable yarn handling device comprising: a vacuum string-up gun having a passage with an entrance through which a first yarn is pulled; a source of pressurized fluid connected to said passage; a support attached to said string-up gun, said support extending beyond said entrance of the passage; an entangling jet having an elongated passage through which said first yarn passes to said string-up gun and through which a second yarn passes past said string-up gun, said entangling jet being attached to said support beyond the entrance to the string-up gun passage; and a connecting passage between said source of pressurized fluid and said entangling jet.

2. The portable yarn handling device of claim 1 including a fluid actuated cutting device mounted to said support between said entangling jet and said entrance to said string-up device passage for cutting said first yarn when the cutting device is actuated.

3. The portable yarn handling device of claims 1 or 2 including means for intermittently and simultaneously connecting said source of pressurized fluid, said entangling jet and said cutting device, whereby said first yarn is cut when said first and second yarns are entangled.

* * * * *